US007605340B2

(12) United States Patent
Duan

(10) Patent No.: US 7,605,340 B2
(45) Date of Patent: Oct. 20, 2009

(54) APPARATUS FOR COOLING PLASMA ARC TORCH NOZZLES

(75) Inventor: Zheng Duan, Hanover, NH (US)

(73) Assignee: Hypertherm, Inc., Hanover, NH (US)

( * ) Notice: Subject to any disclaimer, the term of this patent is extended or adjusted under 35 U.S.C. 154(b) by 312 days.

(21) Appl. No.: 11/415,234

(22) Filed: May 1, 2006

(65) Prior Publication Data

US 2006/0289396 A1 Dec. 28, 2006

Related U.S. Application Data

(63) Continuation-in-part of application No. 11/407,370, filed on Apr. 19, 2006.

(60) Provisional application No. 60/672,777, filed on Apr. 19, 2005.

(51) Int. Cl.
*H05B 1/02* (2006.01)

(52) U.S. Cl. ..... 219/121.51; 219/121.49; 219/121.5; 219/75; 313/231.31

(58) Field of Classification Search ..... 219/121.48, 219/121.5, 121.51, 121.52, 121.49, 121.59, 219/74, 75; 313/231.31, 231.41
See application file for complete search history.

(56) References Cited

U.S. PATENT DOCUMENTS

| | | | | |
|---|---|---|---|---|
| 3,578,943 | A * | 5/1971 | Schoumaker | 219/121.47 |
| 5,164,568 | A | 11/1992 | Sanders | |
| 5,208,448 | A | 5/1993 | Everett | |
| 5,451,739 | A | 9/1995 | Nemchinsky et al. | |
| 5,591,356 | A | 1/1997 | Sakuragi et al. | |
| 5,653,895 | A | 8/1997 | Shintani | |
| 5,906,758 | A * | 5/1999 | Severance, Jr. | 219/121.5 |
| 6,118,097 | A | 9/2000 | Kaga et al. | |
| 6,172,323 | B1 | 1/2001 | Ishide et al. | |
| 6,207,923 | B1 | 3/2001 | Lindsay | |
| 6,610,959 | B2 | 8/2003 | Carlson et al. | |
| 6,667,459 | B1 | 12/2003 | Woods et al. | |
| 6,774,336 | B2 | 8/2004 | Horner-Richardson et al. | |
| 6,924,004 | B2 | 8/2005 | Rao et al. | |
| 2001/0025833 | A1 | 10/2001 | Kelkar et al. | |
| 2002/0135283 | A1* | 9/2002 | Hackett et al. | 313/231.41 |
| 2002/0150669 | A1 | 10/2002 | Pui et al. | |
| 2004/0177807 | A1 | 9/2004 | Pui et al. | |
| 2005/0082263 | A1 | 4/2005 | Koike et al. | |
| 2007/0082083 | A1* | 4/2007 | Fairy | 425/564 |

FOREIGN PATENT DOCUMENTS

| | | |
|---|---|---|
| DE | 4407913 | 10/1994 |
| EP | 0941018 | 9/1999 |
| WO | 03/089178 | 10/2003 |

* cited by examiner

*Primary Examiner*—Mark H Paschall
(74) *Attorney, Agent, or Firm*—Proskauer Rose, LLP

(57) ABSTRACT

The invention relates to a nozzle for a plasma arc torch and methods of manufacturing the nozzle. The nozzle includes a nozzle body and a nozzle liner. The nozzle body has a cylindrical portion and the nozzle liner has a cylindrical section in close thermal contact with a majority of an interior surface of a cylindrical portion of the nozzle body.

24 Claims, 7 Drawing Sheets

APPARATUS FOR COOLING PLASMA ARC TORCH NOZZLES

RELATED APPLICATIONS

This application claims the benefit of the filing date of U.S. Provisional Patent Application Ser. No. 60/672,777, filed on Apr. 19, 2005, entitled "Plasma Arc Torch Providing Angular Shield Flow Injection" by Duan et al., the entirety of which is incorporated herein by reference. This application also claims the benefit of and is a continuation-in-part of U.S. Ser. No. 11/407,370, entitled "Plasma Arc Torch Providing Angular Shield Flow Injection" by Duan et al. filed on Apr. 19, 2006, the entirety of which is incorporated herein by reference.

FIELD OF THE INVENTION

The invention generally relates to the field of plasma arc torches. In particular, the invention relates to an improved nozzles useful in high amperage ranges of torch operation and a method of manufacturing such nozzles.

BACKGROUND OF THE INVENTION

Conventional plasma arc cutting torches produce a transferred plasma jet with current density that is typically in the range of 20,000 to 40,000 amperes/in$^2$. High definition/high performance torches are characterized by narrower jets with higher current densities, typically about 60,000 amperes/in$^2$. High definition/high performance torches are desirable since they produce a narrow cut kerf and a square cut angle. They also have a thinner heat affected zone and are more effective than conventional plasma arc cutting torches at producing a dross free cut and blowing away molten metal.

In plasma arc cutting, one effective way of producing the high quality cuts afforded by high definition/high performance torches is to utilize a vented nozzle design, such as is disclosed in U.S. Pat. No. 5,317,126. In a vented nozzle design, a portion of the plasma gas flows through the nozzle exit orifice used for cutting and the remaining portion of the plasma gas is bled or vented out of the nozzle prior to entering the nozzle orifice. Such vented nozzles produce straight and square cutting edges, small cutting kerfs, and achieve higher cut speeds without dross.

Prior vented nozzles are limited as to the torch conditions that they can withstand. For example, vented nozzles have not been successfully implemented for plasma cutting processes requiring greater than 200 amperes. Upon exposure to amperage conditions greater than 200 amperes, prior nozzles become too hot and, as a result, one or more of: an arc fails to form, double arcs form, cut quality suffers, nozzles melt, portions of the nozzle char, and portions of the nozzle become deformed.

SUMMARY OF THE INVENTION

The improved nozzle overcomes the limitations of prior vented nozzles and can be employed in high current and/or high amperage ranges including torch conditions greater than 200 amperes. The improved nozzle maximizes the thermal conducting contact area between the nozzle liner and the nozzle body, which provides improved cooling of the nozzle liner. The improved nozzle can be used in applications employing greater than 200 amperage.

In one aspect, the invention relates to a nozzle for a plasma arc torch. The nozzle includes a nozzle body and a nozzle liner. The nozzle body has a hollow interior with a nozzle exit orifice at a distal end. The nozzle body has a cylindrical portion and a conical portion. The liner has a hollow interior and a liner orifice aligned with the nozzle exit orifice. The liner has a cylindrical section and the exterior surface of the cylindrical section is in close thermal contact with a majority of an interior surface of the cylindrical portion of the nozzle body.

In one embodiment, the cylindrical section has a first end converging toward a second end. The interior surface is in close thermal contact with the exterior surface of the liner from the first end to the second end. Optionally, the cylindrical section has one or more steps between the first end and the second end and, similarly, the interior surface has one or more complementary steps. In one embodiment, the cylindrical section has a first region with a first outer diameter and a second region with a second outer diameter smaller than the first outer diameter. In another embodiment, the cylindrical section has an exterior surface contour that conforms to a mated contour of the interior surface of the nozzle body. The exterior surface of the cylindrical section of the nozzle liner can be press fit into the nozzle body.

In one embodiment, one or more gas flow paths are located between the liner exterior surface and the interior surface. One or more grooves defined by an exterior surface of the liner extend from about a first end of the cylindrical section to a distal end of the liner. For example, in one embodiment, the one or more grooves provide the gas flow path between the liner exterior surface and the interior surface of the nozzle body. In another embodiment, a gas flow path is formed from at least a portion of a groove defined by the exterior surface of the liner and at least a portion of a groove defined by the interior surface of the nozzle body. In still another embodiment, a gas flow path is formed from one or more grooves defined by the interior surface of the nozzle body and the exterior surface of the liner. In another embodiment, the liner includes an axial stop defined by an exterior surface of the liner for positioning the liner within the nozzle body.

In another aspect, the invention relates to a nozzle for a plasma arc torch. The nozzle includes a nozzle body and a nozzle liner. The nozzle body has a hollow interior with a nozzle exit orifice at a distal end. The nozzle body has a cylindrical portion and a conical portion, the conical portion has an interior surface. The nozzle liner has a hollow interior and a liner orifice aligned with the nozzle exit orifice. The liner has a conical section the exterior surface of the conical section is in close thermal contact with a majority of the interior surface of the conical portion of the nozzle body. One or more gas flow paths can be located between the liner exterior surface and the nozzle body interior surface. Gas flow paths can be formed from one or more grooves or portions of grooves that provide the gas flow path between the liner exterior surface and the nozzle body interior surface. For example, the gas flow path is formed from at least a portion of a groove defined by the exterior surface of the liner and at least a portion of a groove defined by the interior surface of the nozzle body, a gas flow path is formed from one or more grooves defined by the interior surface of the nozzle body, and/or a gas flow path is formed from one or more groove defined by the exterior surface of the nozzle liner. In one embodiment, the nozzle also includes one or more grooves defined by an exterior surface of the liner extending from an exterior surface of the conical section to a first end of the cylindrical section.

In another aspect, the invention relates to a method of manufacturing a nozzle for use in a plasma arc torch. The method includes, providing a nozzle body having a hollow interior and a nozzle exit orifice at a distal end. The nozzle body has a cylindrical portion. The method also includes press fitting a nozzle liner into the hollow interior of the nozzle body to (a) align a liner exit orifice with the nozzle exit orifice, and (b) provide close thermal contact between an exterior surface of a cylindrical section of the nozzle liner with a majority of an interior surface of the cylindrical portion of the nozzle body.

In one embodiment of the method, the cylindrical section has an exterior surface having a contour that conforms to a mated contour of the interior surface. In another embodiment, the cylindrical section has a first end converging toward a second end, the interior surface is in close thermal contact with an exterior surface of the liner from the first end to the second end. Optionally, the exterior surface of the cylindrical section of the liner has one or more steps between the first end and the second end; the one or more steps are in close thermal contact with one or more complementary steps on the interior surface of the nozzle body. In one embodiment, the one or more steps reduces a distance traveled by the liner to provide close thermal contact with the interior surface of the nozzle body. In another embodiment, the interior surface of the nozzle body has a size smaller than the cylindrical section that the interior surface contacts. For example, the exterior surface of the cylindrical section of the nozzle liner has a larger size (e.g., outer diameter) than the size (e.g., the inner diameter) of the interior surface of the nozzle body that the nozzle liner enters and is press fit therein. In one embodiment, one or more gas flow paths are located between the liner exterior surface and the interior surface of the nozzle body. Gas flow paths can be formed from one or more grooves or portions of grooves that provide the gas flow path between the liner exterior surface and the interior surface of the nozzle body. For example, the gas flow path is formed from at least a portion of a groove defined by the exterior surface of the liner and at least a portion of a groove defined by the interior surface of the nozzle body, a gas flow path is formed from one or more grooves defined by the interior surface of the nozzle body, and/or a gas flow path is formed from one or more groove defined by the exterior surface of the nozzle liner.

In another aspect, the invention relates to a plasma arc torch that includes a torch body, an electrode and a nozzle. The electrode is mounted in the torch body. A nozzle is mounted relative to the electrode in the torch body to define a plasma chamber. The nozzle includes a nozzle body and a nozzle liner. The nozzle body has a hollow interior, a cylindrical portion having an interior surface, and a nozzle exit orifice at the nozzle body's distal end. The nozzle liner has a hollow interior and a liner orifice aligned with the nozzle exit orifice. The liner has a cylindrical section and the exterior surface is in close thermal contact with a majority of the interior surface of the cylindrical portion of the nozzle body.

Optionally, one or more gas flow paths are located between the exterior surface of the liner and the interior surface of the nozzle body. A plasma gas flows through a plasma flow path, through the plasma chamber, a portion of the plasma gas exits the nozzle orifice and a portion of the plasma gas exits one or more gas flow paths.

In one embodiment, the plasma arc torch of claim also has a shield having a central circular opening aligned with the nozzle. In another embodiment, the plasma arc torch has a swirl ring for directing a plasma gas to the plasma chamber.

In another aspect, the invention relates to a nozzle liner having a hollow interior surface, a cylindrical section with a first end outer diameter converging toward a second end outer diameter, and a conical section. The cylindrical section is configured to provide close thermal contact with a majority of an interior surface of a nozzle body when press fit in an interior surface of a nozzle body. In one embodiment, the second end outer diameter provides the base of the conical section of the nozzle liner. In another embodiment, the liner has an axial stop defined by an exterior surface of the liner for positioning the liner within a nozzle body.

BRIEF DESCRIPTION OF THE DRAWINGS

The foregoing and other objects, feature and advantages of the invention, as well as the invention itself, will be more fully understood from the following illustrative description, when read together with the accompanying drawings which are not necessarily to scale.

DETAILED DESCRIPTION

Figure 1:
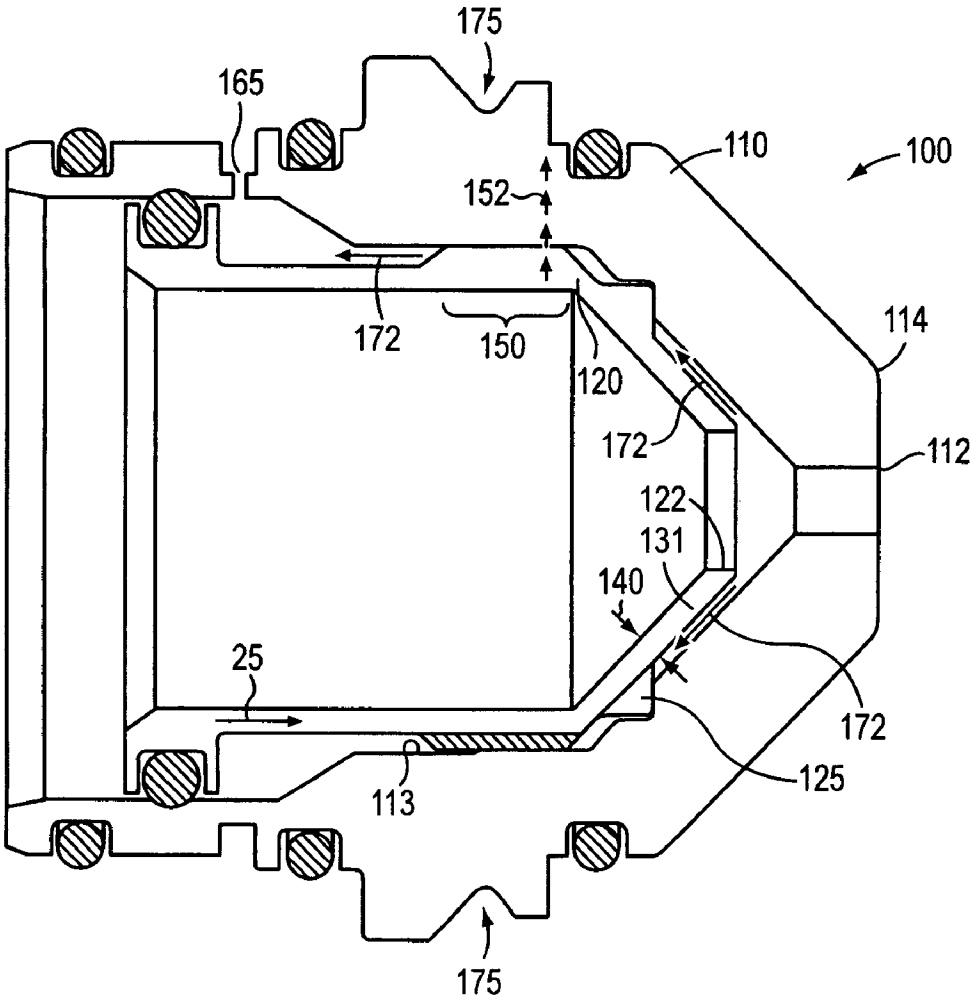
FIG. 1 (PRIOR ART)
FIG. 1 is a cross-sectional view of an illustration of a prior art nozzle.
Figure 2:
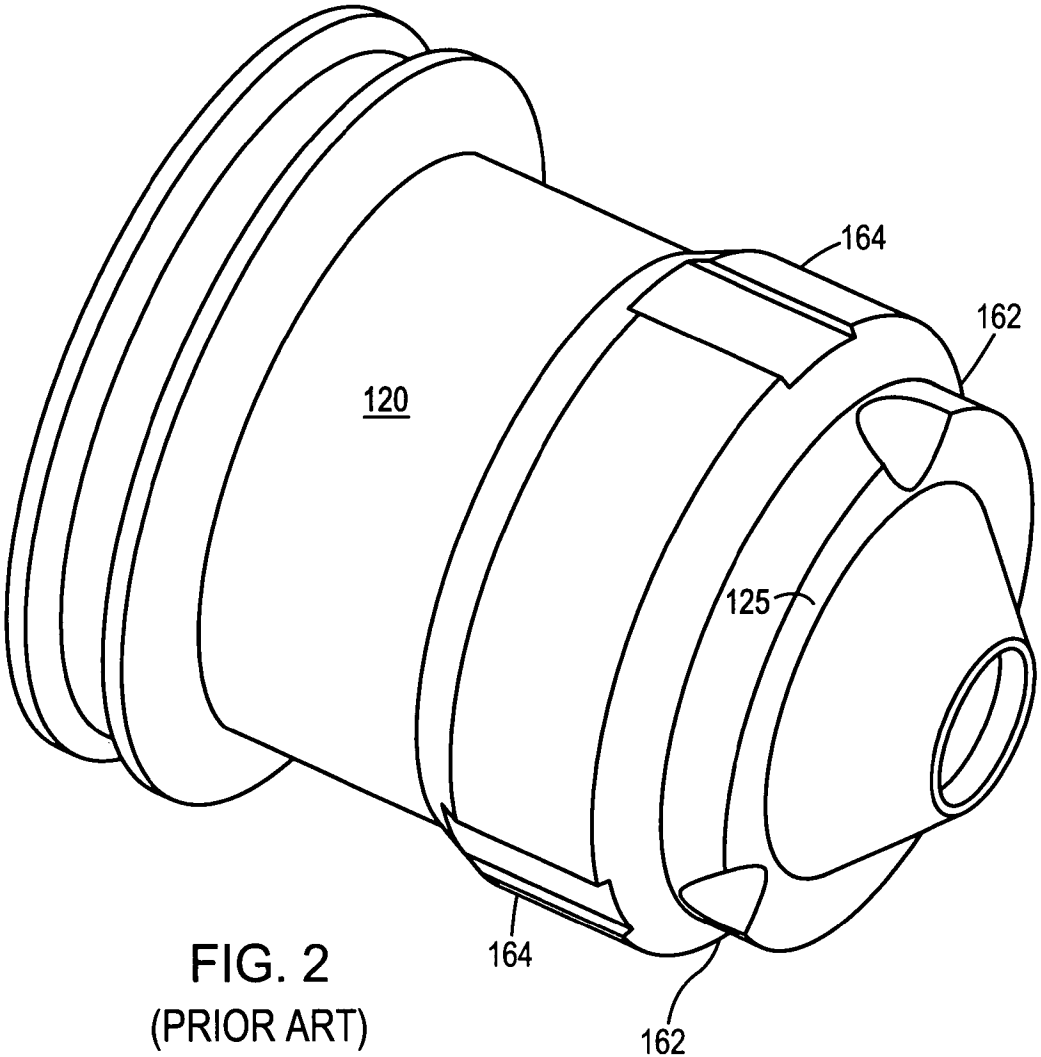
FIG. 2 (PRIOR ART)
FIG. 2 is a side view of an illustration of a prior art nozzle liner.

Prior vented nozzles have not been successfully implemented for plasma cutting processes requiring currents greater than 200 amperes. FIG. 1 shows the cross-section of the HyPerformance® System 200A mild steel nozzle, a vented nozzle available from Hypertherm Inc. (Hanover, N.H.). The nozzle 100 has two pieces, an outside piece called a nozzle body 110 and an inside piece called a nozzle liner 120. A space between the nozzle body interior surface and the exterior surface of the nozzle liner forms a gas flow path 172. A portion of plasma gas is vented from the nozzle 100 via the gas flow path 172 and exits from an aperture in the nozzle body called a vent hole 165 to a vent line and then to the atmosphere. Referring now to FIG. 2, grooves 162, 164 defined on an exterior surface of the nozzle liner 120 enable gas to flow through the gas flow path 172.

During operation, the nozzle 100 needs to be cooled to prevent heat damage from the high temperature plasma jet. In common implementations, the nozzle body 110 is in contact with cooling media such as, for example, a liquid coolant 175 (e.g., a cooling water supply) supplied to the torch body and/or the gas that flows through the torch (e.g., shield gas and/or plasma gas). The nozzle liner 120 has no available cooling media, accordingly, it can only dissipate its thermal load through its contact interface with the nozzle body 110. As shown in FIG. 1, prior vented nozzles use interference press fitting between the liner 120 and the nozzle body 110. Press fitting is an interference fit of the smaller inner diameter of the nozzle body 110 with the larger outer diameter of at least a portion of the nozzle liner 120. In this prior nozzle 100, the press fit between two generally parallel surfaces, each having substantially no gradient, provides a contact. Each of the liner 120 exterior surface and the nozzle body 110 interior surfaces that contact have a single diameter against which the other is press fit to contact 150.

The contact 150 of the press fit dissipates the heat 152 from the liner 120 to the nozzle body 110 via conduction. Once the heat is transferred to the nozzle body 110 the nozzle body 110 is exposed to the above referenced cooling media, (e.g., liquid coolant 175 and/or gas). In addition, the press fitting between the liner 120 and the nozzle body 110 enables location of the liner 120 position relative to the nozzle body 110 thereby ensuring proper alignment to provide the desired cutting performance. During operation, most of the heat is generated about the liner orifice 122 and the conical area 131 of the liner 110 about the liner orifice 122. This thermal energy must be conducted through the conical area 131 to the press fitting contact 150 then to the nozzle body 110. The nozzle body 110 is cooled, in part, by outside media e.g., fluids including gasses and liquids. The conical area 131 has a thickness 140 that measures from about 0.010 inches to about 0.040 inches, from about 0.020 inches to about 0.030 inches, or about 0.035 inches.

During press fitting, the nozzle liner 120 travels through the interior surface 113 of the nozzle body 110. In the design shown in FIGS. 1 and 2, the maximum length of the interference press contact 150 between the liner 120 exterior surface and the nozzle body 110 interior surface is about 0.25 inches. The 0.25 inches contact length requires the nozzle liner 120 to travel about 0.25 inches in the axial direction 25. The travel length is limited by a number of factors including, the force required to press fit the nozzle liner 120 into the interior surface 113 of the nozzle body 110 for a contact area greater than 0.25 inches. Also, apart from the ability to apply such an increased force, the risk associated with pressing the nozzle liner 120 into the nozzle body 110 over a longer distance risks deformation of the nozzle liner 120 caused by the press fitting forces exerted on the nozzle liner 120. Nozzle liner deformation risks and/or limits the effectiveness, accuracy, usefulness, and the life of the nozzle 100. Thus, the press fitting contact 150 is limited by the distance traveled by the nozzle liner 120 in the axial direction 25.

In order to overcome torch nozzle limitations to accommodate plasma arc torches having currents greater than 200 amperes, a torch nozzle is provided that has a nozzle liner exterior surface to nozzle body interior surface contact area that improves conduction from the nozzle liner to the nozzle body. A nozzle liner and a nozzle body are provided to improve the heat load handling capability of the nozzle. In one embodiment, the nozzle maximizes the thermal conducting area from the nozzle liner to the nozzle body by use of, for example, a larger press fit area and by, for example, providing an increased close thermal contact area between the liner exterior surface and the nozzle body interior surface. Thus, the increased contact area improves cooling of the liner via conduction of thermal energy generated at the liner orifice through the nozzle body. The nozzle body enables liner cooling and, optionally, the nozzle body is in contact with outside cooling media such as, for example, fluids including gas (e.g., plasma gas and/or shield gas) and/or cooling water. The improved nozzle enables use in higher current applications, for example over 200 amperes. In one embodiment, the nozzle is employed in a torch operating at about 400 amperes.

Figure 3:
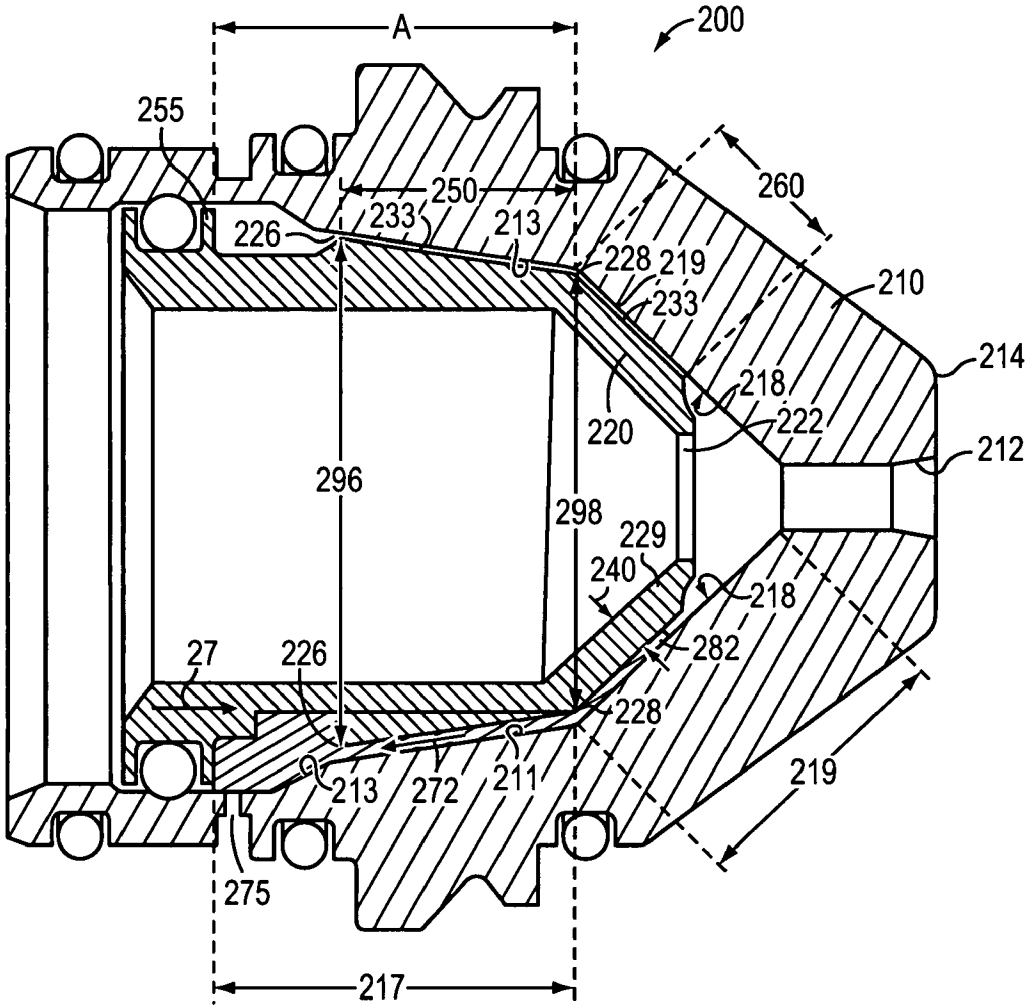
FIG. 3 is a cross-sectional view of an illustration of a nozzle of the invention.
Figure 4:
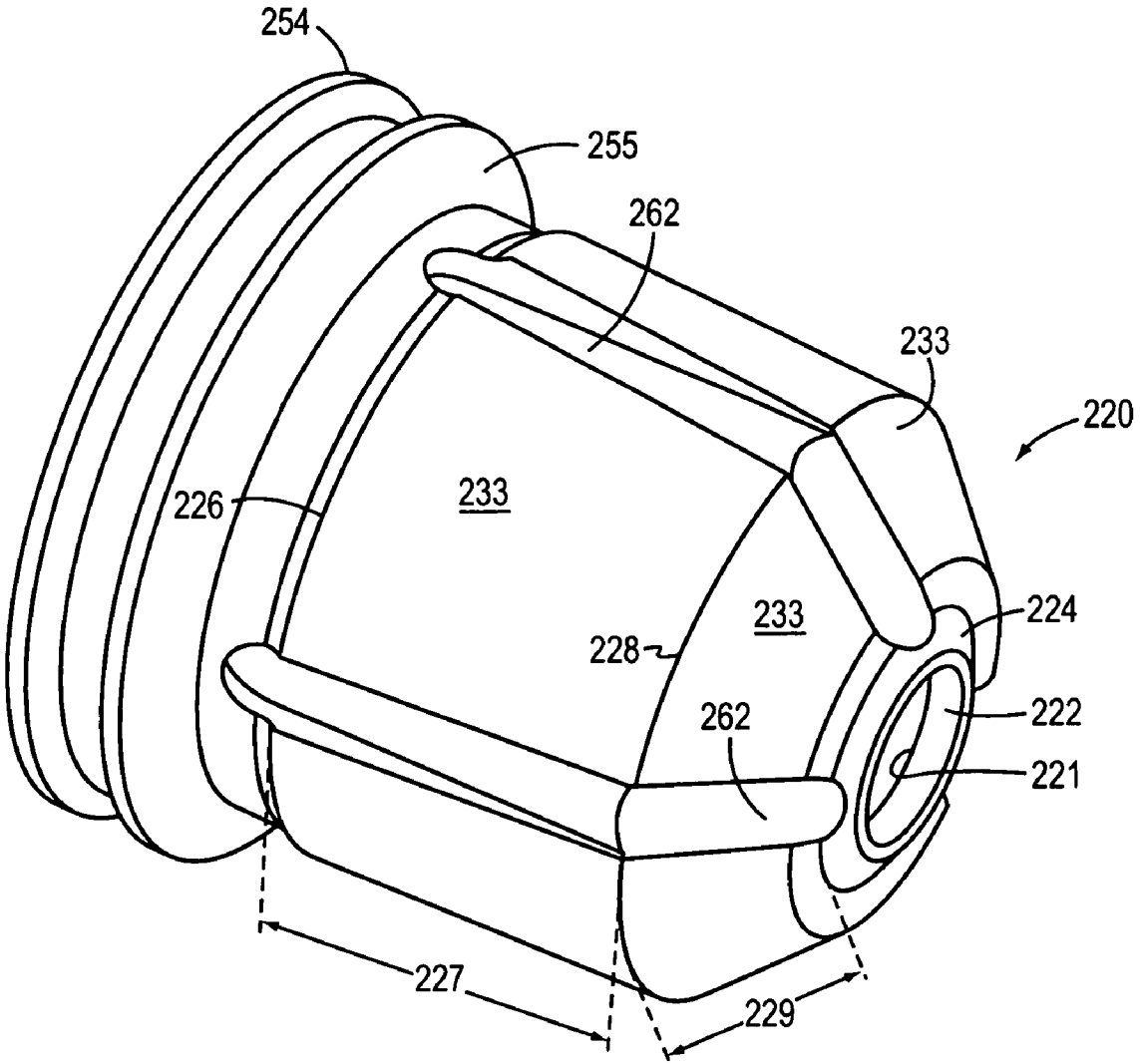
FIG. 4 is a side view of an illustration of a nozzle liner of the invention.

FIGS. 3 and 4 illustrate a nozzle of the invention. The nozzle 200 includes a nozzle body 210 and a nozzle liner 220. The nozzle body 210 has a nozzle exit orifice 212 at its distal end 214 and the nozzle body 210 has a hollow interior 211. The nozzle body 210 has a cylindrical portion 217 with an interior surface 213. The nozzle body 210 has a conical portion 219 with an interior surface 218. The nozzle body 210 can be formed from any of a number of materials including, for example, metals, such as copper, silver, steel, metal alloys, ceramic materials, and any combinations of these. Suitable materials employed to form the nozzle body 210 have good thermal conductivity. The nozzle liner 220 has a hollow interior 221 and a liner orifice 222. The liner 220 has a cylindrical section 227 and a conical section 229. The nozzle liner 220 has a lip 255 that is substantially perpendicular to the axis of the cylindrical section 227. The lip 255 is disposed on the proximal end 254 of the nozzle liner 220. The nozzle liner 220 can be formed from any of a number of materials including, for example, metals, such as copper, silver, steel, metal alloys, ceramic materials, and any combinations of these. Suitable materials employed to form the nozzle liner 220 have good thermal conductivity.

The nozzle liner 220 is pressed into the hollow interior 211 of the nozzle body 210. For example, the conical section 229 of the nozzle liner 220 first enters into the nozzle body 210 hollow interior 211 and is pressed in the axial direction 27. The liner orifice 222 is aligned with the nozzle exit orifice 212. In one embodiment, the cylindrical section 227 of the nozzle liner 220 is press fit into the hollow interior 211 of the nozzle body 210. The exterior surface 233 of the cylindrical section 227 of the nozzle liner 220 is in close thermal contact 250 with a majority of an interior surface 213 of the cylindrical portion 217. In one embodiment, the exterior surface 233 of the cylindrical section 227 of the nozzle liner 220 is press fit to the interior surface 213 of the cylindrical portion 217. The cylindrical portion 217 interior surface 213 is the surface within the cylindrical portion 217 of the nozzle body 210 defined by the region A, between where nozzle liner 220 lip 255 is opposite the nozzle body 210 and where the conical portion 219 of the nozzle body begins. In one embodiment, the exterior surface 233 of the nozzle liner 220 is in close thermal contact 250 with a majority of the interior surface 213, for example, there is physical contact without a gap between the exterior surface 233 of the liner 220 and the interior surface 213 of the nozzle body 210. The close thermal contact 250 between the exterior surface 233 of the nozzle liner 220 and the interior surface 213 of the nozzle 211 can be a percentage value of greater than 50% of the interior surface of the nozzle body 210. The contact 250 of the nozzle liner 220 cylindrical section 227 exterior surface 233 with the interior surface 213 of the cylindrical portion 217 has a percentage value of the interior surface 213 within the range of, from about 55% to about 100%, from about 70% to about 95%, or from about 60% to about 75%, for example.

In one embodiment, the exterior surface 233 of the conical section 229 of the nozzle liner 220 is press fit into the hollow interior 211 of the nozzle body 210. The exterior surface 233 of the conical section 229 of the nozzle liner 220 is in close thermal contact 260 with a majority of an interior surface 218 of the conical portion 219. The interior surface 218 of the conical portion 219 is, for example, the inside surface area of the conical portion 219. The contact 260 between the exterior surface 233 of the nozzle liner 220 conical section 229 and the interior surface 218 of the conical portion 219 can be a percentage value of greater than 50% of the interior surface of the conical portion. The contact 250 of the nozzle liner 220 conical section 229 exterior surface 233 with the interior surface 218 of the cylindrical portion 217 has a percentage value of the interior surface within the range of from about 55% to about 100%, from about 70% to about 95%, or from about 60% to about 75%, for example.

In one torch nozzle the exterior surface 233 of the conical section 229 of the liner 220 is in close thermal contact 260 with the interior surface 218 of the conical portion 219 of the nozzle body 210 and the exterior surface 233 of the cylindrical section 227 of the nozzle liner 220 is in close thermal contact 250 with the interior surface 213 of the cylindrical portion 217 of the nozzle body 210. In one nozzle 200, there is at least one space gap 282 between the exterior surface 233 of the conical section 229 and the interior surface 218 of the conical portion 219. The contact 250 of the press fit between the nozzle liner 220 and the nozzle body 210 dissipates heat from the liner 220 to the nozzle body 210 via conduction.

Referring still to FIGS. 3 and 4, in one embodiment, the cylindrical section 227 has a first end 226 and a second end 228 and the first end 226 converges toward the second end 228. The nozzle body 210 interior surface 211 is in close thermal contact 250 with the exterior surface 233 of the liner 220 from the first end 226 to the second end 228. In one embodiment, the first end 226 has a first outer diameter 296 and converges in measurement toward the second end 228, which has a second outer diameter 298. In one embodiment, there is consistent decline in outer diameter measurement between the first end 226 and the second end 228. Alternatively, the outer diameter decline is not constant and rather there are regions (e.g., thousandths of inches) of consistent outer diameter measurement and the measurement between the first end 226 and the second end 228 converge. In one embodiment, the exterior surface 233 of the nozzle liner 220 cylindrical section 227 has a contour that conforms to a mated contour of the interior surface 213 of the nozzle body 210.

In one embodiment, one or more gas flow paths 272 are located between the liner 220 and the interior 211 of the nozzle body 210, which includes interior surfaces 213 and 218. For example, in one embodiment, one or more grooves provide the gas flow path 272 between the liner 220 and the interior 211 surface of the nozzle body 210. The gas flow path 272 can be formed from at least a portion of a groove defined by the exterior surface 233 of the liner 220 and at least a portion of a groove defined by the interior 211 surface (e.g., interior surfaces 213, 218) of the nozzle body 210. In still another embodiment, a gas flow path 272 is formed from one or more grooves defined by the interior 211 surface (e.g., interior surfaces 213, 218) of the nozzle body 210. In one embodiment, the liner 220 has one or more grooves 262 that extend from, for example, about a first end 226 of the cylindrical section 227 to a distal end 224 of the liner 220.

In one embodiment, the nozzle liner 220 has a hollow interior surface 221, a cylindrical section 227 with a first end 226 outer diameter 296 converging toward a second end 228 outer diameter 298, and a conical section 229. The cylindrical section 227 exterior surface 233 is configured to provide close thermal contact with a majority of an interior surface 213 of a nozzle body 210 when press fit therein. In one embodiment, second end 228 outer diameter 298 is the base of the conical portion 229. The conical section 229 has a thickness 240 that ranges from about 0.070 to about 0.10 inches, from about 0.080 to about 0.090 inches, or about 0.075 to about 0.085 inches.

Figure 5:
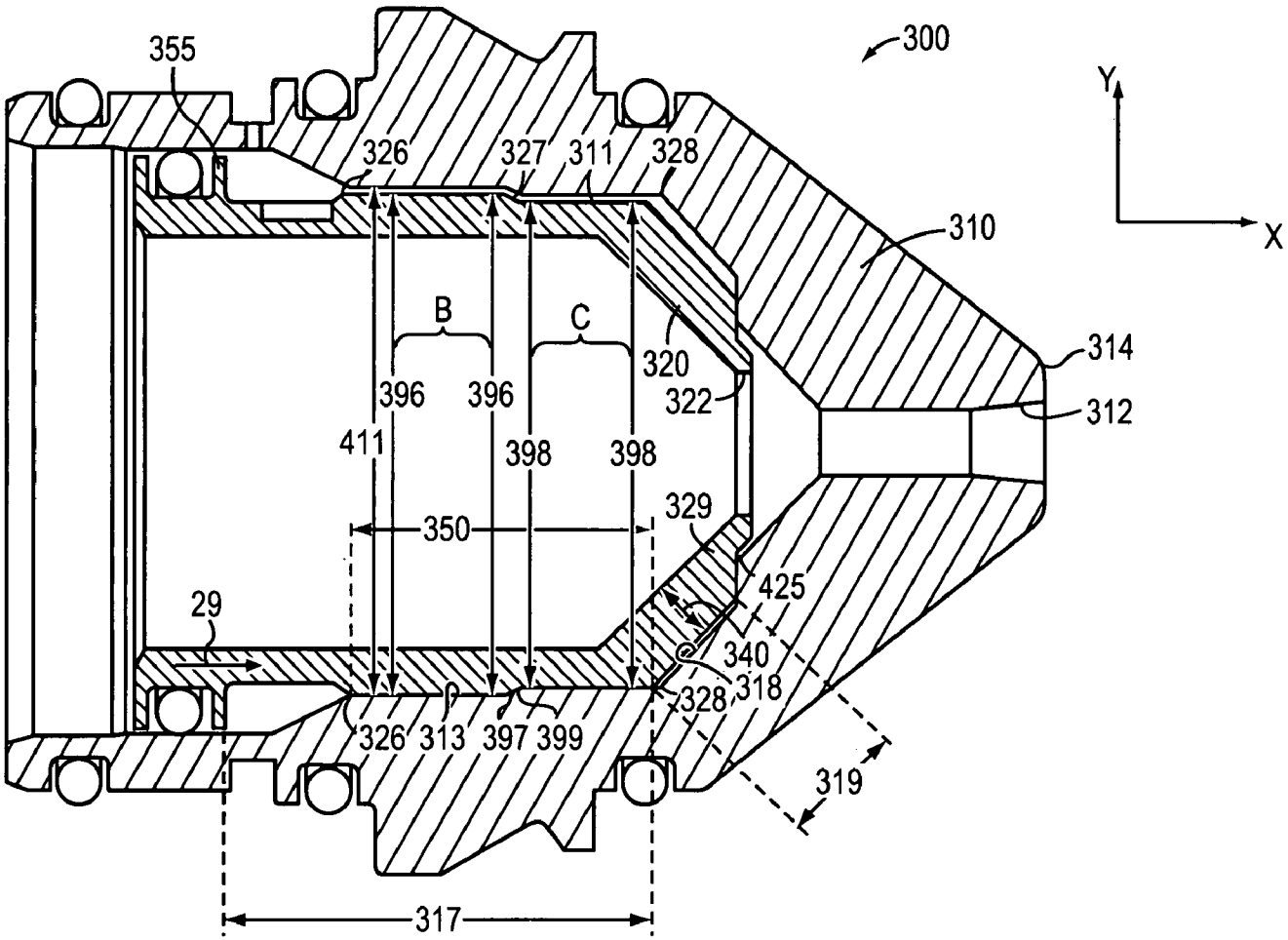
FIG. 5 is a cross-sectional view of an illustration of a nozzle of the invention.
Figure 6:
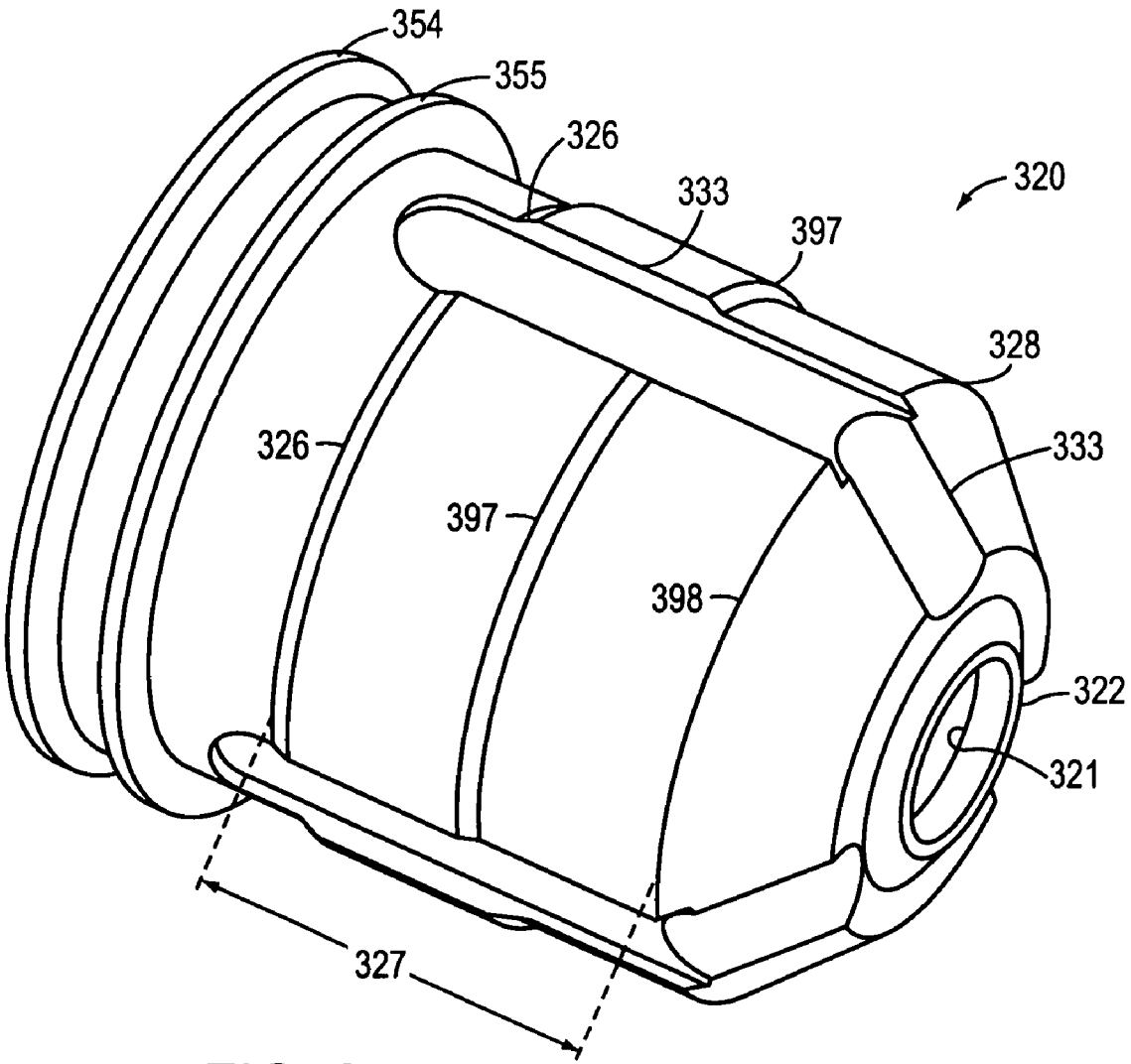
FIG. 6 is a side view of an illustration of a nozzle liner of the invention.

FIGS. 5 and 6 illustrate another embodiment of the nozzle 300 of the invention. The nozzle 300 includes a nozzle body 310 and a nozzle liner 320. The nozzle body 310 has a nozzle exit orifice 312 at its distal end 314 and the nozzle body 310 has a hollow interior 311. The nozzle body 310 has a cylindrical portion 317 with an interior surface 313. The nozzle body has a conical portion 319 with an interior surface 318. The nozzle liner 320 has a hollow interior 321 and a liner orifice 322. The liner 320 has a cylindrical section 327, a conical section 329, and an exterior surface 333.

The nozzle liner 320 is press fit into the hollow interior 311 of the nozzle body 310 such that the nozzle liner 320 enters into the nozzle body 310 hollow interior 311 and is pressed in the axial direction 29. The liner orifice 322 is aligned with the nozzle exit orifice 312. The exterior surface 333 of the cylindrical section 327 of the nozzle liner 320 is in close thermal contact 350 with at least a portion of the interior surface 313 of the cylindrical portion 317. In one embodiment, the nozzle liner 320 is in close thermal contact 350 such that the liner 320 exterior surface 333 physically touches, with no gap or space therebetween, a majority of the interior surface 313 of the cylindrical portion. The contact 350 of the nozzle liner 320 cylindrical section 327 with the interior surface 313 of the cylindrical portion 317 is a percentage value greater than 50% of the interior surface 313. The contact 350 of the nozzle liner 320 cylindrical section 327 with the interior surface 313 of the cylindrical portion 317 has a percentage value of the interior surface 313 of from about 55% to about 100%, from about 70% to about 95%, or from about 60% to about 75%, for example.

The nozzle liner 320 cylindrical section 327 has a first end 326 and a second end 328 and the cylindrical section 327 has a step 397 between the first end 326 and the second end 328. Similarly, in one embodiment, the nozzle body 310 interior surface 313 has a complementary step 399 that is complementary to the step 397. For example, in one embodiment, the nozzle liner 320 has two steps and the interior surface of the nozzle body 310 has two complementary steps. In one embodiment, the cylindrical section 327 has a first region B with a first outer diameter 396 and a second region C with a second outer diameter 398 smaller than the first outer diameter 396. In one embodiment, the drop between the two outer diameters 396, 398 occurs at a step 397 which is a point on the exterior surface 333 of the cylindrical surface 317 in which the outer diameter is reduced. The step 397 between the two outer diameters 396, 398 can have a gradient or, alternatively, can drop off at, for example, an angle of about 90°. In one embodiment, the outer diameter 396 measures 0.6406 inches and the complementary inner diameter of the interior surface 313 measures 0.6388 inches and the outer diameter 398 measures 0.6275 inches and the complementary inner diameter of the interior surface 313 measures 0.6262 inches.

In one embodiment, the one or more steps 397 present on the nozzle liner 310 reduces the distance traveled by the liner 320 in the axial direction 29 to provide close thermal contact 350 with the interior surface 313. For example, if the region B measures about 0.25 inches and region C measures about 0.25 inches, in order to provide a press fit contact 350 of about 0.50 inches between the exterior surface 333 of the liner 320 and the interior surface 313 of the nozzle body 310, the liner 320 is not required to be subjected to the press fit force over 0.50 inches along the axial direction 29. Rather, because the exterior surface 333 of the cylindrical section 327 is divided into two sections by the step 397, the liner 320 is press fit over a distance of about 0.25 inches. In this way, the risk of damage and deformation to the liner 320 caused by the pressure and strain of press fitting to achieve close thermal contact 350 of the exterior surface 333 of the liner 320 with the majority of an interior surface 313 of the cylindrical portion 317 of the nozzle body 310 is lessened. The press fit force required for the exterior surface 333 of the liner 320 to be placed in close thermal contact 350 with the interior 311 of the nozzle body 310 may be larger than in applications where a press fit distance of 0.25 inches provides close thermal contact measuring 0.25 inches in length along the X axis, however, the force is less than would be required to press fit a cylindrical section 327 over 0.50 inches of contact 350 distance where the cylindrical section 327 has a single outer diameter measuring 0.50 inches is press fit into the interior 311 of a nozzle body 310. Thus, the manufacturing applied pressure needs for press fitting is lessened in order to achieve contact 350 of the exterior surface 333 of the cylindrical section 327 with a majority of the interior surface 313 of the nozzle body 310. The contact area and the liner press fit travel distance can be balanced by the selected number of steps present on the cylindrical section 327 and/or the cylindrical portion 317.

The nozzle body 310 interior surface 313 is in close thermal contact 350 with the exterior surface 333 of the liner 320 from the first end 326 to the second end 328. In one embodiment, the nozzle liner 320 cylindrical section 327 has an exterior surface 333 contour that conforms to a mated contour of the interior surface 313. In one embodiment, the nozzle body 310 interior surface 313 has a size smaller than the exterior surface 333 of the cylindrical section 327 that the interior surface 313 contacts 350. For example, the diameter 411 of the interior surface 313 is smaller than the diameter 396 of the exterior surface 333 of the cylindrical section 327 such that the interior surface 313 contacts the exterior surface 333 at the point of close thermal contact 350 with no gap or space therebetween. In one embodiment, the diameter 411 measures 0.6388 inches and the diameter 396 measures 0.6406 inches.

The nozzle liner 320 has an axial stop 425 that aids in positioning the liner 320 in the nozzle body 310 interior 311 when the liner 320 is pressed in the axial direction 29. The axial stop 425 is an extrusion that positions the liner 320 in the nozzle body 310. In one embodiment, the axial stop 425 is defined by an exterior surface 333 of the liner 320 and functions to position the liner 320 within the nozzle body 310. In one embodiment, the axial stop 425 prevents the liner 320 from progressing beyond a set distance in the axial direction 29 within the nozzle body 310. The axial stop 425 is close to the liner orifice 322. The shortened distance between the axial stop 425 and the liner orifice 322 compared to prior nozzles (see e.g., FIGS. 1 and 2 and note the distance between the axial stop 125 and the liner orifice 122 is greater than two times the distance between the axial stop 425 and the liner orifice 322) enables an increase in the thickness 340 of the conical section 329. The conical section 329 has a thickness 340 that ranges from about 0.070 to about 0.10 inches, from about 0.080 to about 0.090 inches, or about 0.075 to about 0.085 inches. The improved thickness 340 provides a larger thermal conducting cross-section for the heat flux from the liner 320 orifice 322 to the proximal end 354 of the liner 320.

The improved nozzle described in relation to FIGS. 2-6 has been employed in the HyPerformance® System 260 ampere mild steel process (Hypertherm Inc., Hanover, N.H.) and in the HyPerformance® System 260 ampere mild steel bevel process (Hypertherm Inc., Hanover, N.H.) with nozzle life similar to the prior Hypertherm HyPerformance System 200 ampere processes described in relation to FIGS. 1-2.

The length of the contact area of the press fit may be selected according to the application, for example, in a Hypertherm HyPerformance System 260 ampere bevel application, the exterior surface of the nozzle liner cylindrical section is in close thermal contact with a portion of the interior surface of the cylindrical portion that has a percentage value between about 50% and about 98%, or about 75% of the interior surface of the cylindrical portion. The amount of contact can be tailored to the application to maximize cut quality and consumable life and/or to provide a similar level of cut quality and consumable life as compared to a lower amperage application.

Figure 7:
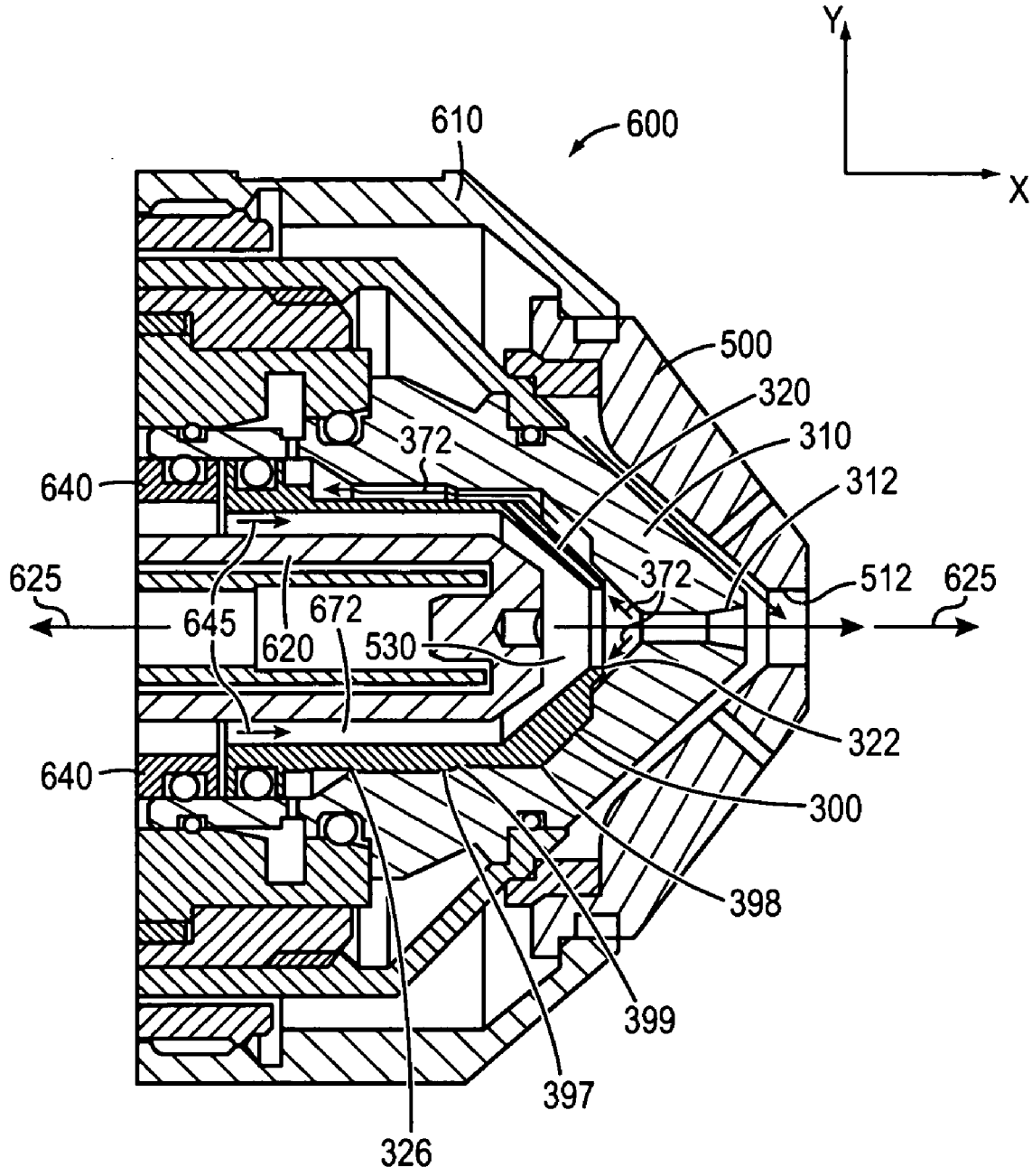
FIG. 7 is a cross-sectional view of a schematic diagram of a portion of a plasma arc torch.

FIG. 7 is a cross-sectional view of a schematic diagram of a plasma arc torch 600. The plasma arc torch 600 includes a torch body 610 and an electrode 620 is mounted in the torch body 610. A nozzle 300 is mounted relative to the electrode 620 to define a plasma chamber 530. Referring also to FIGS. 4 and 5, the nozzle 300 has a nozzle body 310 and a nozzle liner 320. The nozzle body 310 has a hollow interior 311, a cylindrical portion 317, and a nozzle exit orifice 312 at a distal end 314. The nozzle liner 320 has a hollow interior 321 and a liner orifice 322 aligned with the nozzle exit orifice 312. The liner 320 has an exterior surface 333 of the cylindrical section 327 in close thermal contact 350 with a majority of an interior surface 313 of the cylindrical portion 317 of the nozzle body 310.

In one embodiment, one or more gas flow paths 372 are located between the liner 320 exterior surface 333 and the nozzle body 310 interior 311 surface. In another embodiment, the plasma arc torch 600 has a swirl ring 640 for directing a plasma gas 645 to the plasma chamber 530. The swirl ring 640 is partially depicted in FIG. 7. In one embodiment, a plasma gas 645 flows through a plasma flow path 672, through the plasma chamber 530, a portion of the plasma gas 645 exits the nozzle orifice 312 and a portion of the plasma gas 645 exits one or more gas flow paths 372.

In one embodiment, the plasma arc torch has a shield 500 with a central circular opening 512 aligned with the nozzle 300. The nozzle 300 and the shield 500 are spaced from each other along a longitudinal axis 625 of the plasma arc torch 600. Both the nozzle 300 and shield 500 are formed from electrically and/or thermally conductive materials. In some embodiments, both the nozzle and shield are formed of the same electrically conductive material and, in other embodiments, the nozzle and shield are formed of different electrically conductive materials. Examples of electrically conductive materials suitable for use with the invention include copper, aluminum, and brass, for example. The plasma arc torch, the nozzle, the nozzle body, and the nozzle liner described above can be employed in, for example, any mechanized and/or high current plasma arc torch system.

The plasma arc torch, the nozzle, the nozzle liner, the nozzle body, and the method of manufacturing the nozzle, and other aspects of what is described herein can be implemented in cutting systems, welding systems, spray coating systems, and other suitable systems known to those of ordinary skill in the art. Variations, modifications, and other implementations of what is described herein will occur to those of ordinary skill without departing from the spirit and the scope of the invention. Accordingly, the invention is not to be defined only by the preceding illustrative description.

What is claimed is:

1. A nozzle for a plasma arc torch comprising:

a nozzle body having a hollow interior with a nozzle exit orifice at a distal end, the nozzle body having a cylindrical portion and a conical portion, the cylindrical portion having an interior surface; and a nozzle liner having a hollow interior and being disposed in the hollow interior of the nozzle body such that a liner orifice is aligned with the nozzle exit orifice, the nozzle liner having a cylindrical sections, the cylindrical section having an exterior surface a majority of which is in contact with the interior surface of the cylindrical portion of the nozzle body to form a thermal contact region, the thermal contact region dissipating heat between the nozzle liner and the cylindrical portion of the nozzle body via thermal conduction.

2. The nozzle of claim 1 wherein the cylindrical section has a first end converging toward a second end, the interior surface is in close thermal contact with the nozzle liner from the first end to the second end.

3. The nozzle of claim 2 wherein the cylindrical section has one or more steps between the first end and the second end.

4. The nozzle of claim 1 wherein the majority of the exterior surface of the cylindrical section of the nozzle liner is in contact with a majority of the interior portion of the cylindrical portion of the nozzle body.

5. The nozzle of claim 1 wherein the cylindrical section is press fit to the interior surface.

6. The nozzle of claim 1 wherein one or more gas flow paths are located between the nozzle liner and the interior surface.

7. The nozzle of claim 1 further comprising one or more grooves defined by an exterior surface of the nozzle liner extending from about a first end of the cylindrical section to a distal end of the liner.

8. The nozzle of claim 1 wherein the cylindrical section has a first region with a first outer diameter and a second region with a second outer diameter smaller than the first outer diameter.

9. The nozzle of claim 1 wherein the cylindrical section has a contour that conforms to a mated contour of the interior surface.

10. The nozzle of claim 1 further comprising an axial stop defined by an exterior surface of the nozzle liner for positioning the liner within the nozzle body.

11. A method of manufacturing a nozzle for use in a plasma arc torch comprising:

providing a nozzle body having a hollow interior and a nozzle exit orifice at a distal end, the nozzle body having a cylindrical portion; and press fitting a nozzle liner into the hollow interior of the nozzle body to (a) align a liner exit orifice with the nozzle exit orifice, and (b) provide contact between a majority of an exterior surface of the cylindrical section of the nozzle liner with an interior surface of the cylindrical portion of the nozzle body to form a thermal contact region that dissipates heat between the nozzle liner and the cylindrical portion of the nozzle body via thermal conduction.

12. The method of claim 11 wherein the cylindrical section has a first end converging toward a second end, the interior surface is in close thermal contact with the nozzle liner from the first end to the second end.

13. The method of claim 12 wherein the cylindrical section has one or more steps between the first end and the second end, the one or more steps down are in close thermal contact with one or more complementary steps on the interior surface.

14. The method of claim 11 wherein the majority of the exterior surface of the cylindrical section of the nozzle liner is in contact with a majority of the interior portion of the cylindrical portion of the nozzle body.

15. The method of claim 11 wherein the interior surface has a size smaller than the cylindrical section that the interior surface contacts.

16. The method of claim 11 wherein the cylindrical section has a contour that conforms to a mated contour of the interior surface.

17. The method of claim 11 wherein one or more gas flow paths are located between the liner and the interior surface.

18. A plasma arc torch comprising:

a torch body, an electrode mounted in the torch body; and a nozzle mounted relative to the electrode in the torch body to, at least in part, define a plasma chamber, the nozzle having a nozzle body with a hollow interior, a cylindrical portion, and a nozzle exit orifice at a distal end and a nozzle liner having a hollow interior and a liner orifice aligned with the nozzle exit orifice, the liner having a cylindrical section a majority of which is in contact with an interior surface of the cylindrical portion of the nozzle body to form a thermal contact region that dissipates heat between the nozzle liner and the cylindrical portion of the nozzle body via thermal conduction.

19. The plasma arc torch of claim 18 further comprising a shield having a central circular opening aligned with the nozzle.

20. The plasma arc torch of claim 18 further comprising a swirl ring for directing a plasma gas to the plasma chamber.

21. The plasma arc torch of claim 18 wherein one or more gas flow paths are located between the liner and the interior surface.

22. The plasma arc torch of claim 21 wherein a plasma gas flows through a plasma flow path, through the plasma chamber, a portion of the plasma gas exits the nozzle orifice and a portion of the plasma gas exits one or more gas flow paths.

23. A nozzle for a plasma arc torch comprising:

a nozzle body having a hollow interior with a nozzle exit orifice at a distal end; and a nozzle liner having a hollow interior and being disposed in the hollow interior of the nozzle body such that nozzle liner orifice is aligned with the nozzle exit orifice, the nozzle liner having an exterior surface a majority of which is in contact with an interior surface of the nozzle body to form a thermal contact region that dissipates heat between the nozzle liner and the nozzle body via thermal conduction.

24. The nozzle of claim 23 further comprising one or more grooves defined by an exterior surface of the nozzle liner extending from about an axial stop at a first end of the nozzle liner to a distal end of the liner.

* * * * *

UNITED STATES PATENT AND TRADEMARK OFFICE

CERTIFICATE OF CORRECTION

PATENT NO. : 7,605,340 B2
APPLICATION NO. : 11/415234
DATED : October 20, 2009
INVENTOR(S) : Zheng Duan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 484 days.

Signed and Sealed this

Fifth Day of October, 2010

David J. Kappos

David J. Kappos
*Director of the United States Patent and Trademark Office*